United States Patent [19]

Morokawa

[11] 4,441,825

[45] Apr. 10, 1984

[54] LOW-POWER INTEGRATED CIRCUIT FOR AN ELECTRONIC TIMEPIECE

[75] Inventor: Shigeru Morokawa, Tokyo, Japan

[73] Assignee: Citizen Watch Co., Ltd., Tokyo, Japan

[21] Appl. No.: 931,277

[22] Filed: Aug. 4, 1978

Related U.S. Application Data

[63] Continuation-in-part of Ser. No. 721,440, Sep. 8, 1976, abandoned.

[30] Foreign Application Priority Data

Sep. 8, 1975 [JP] Japan ..... 50-108629

[51] Int. Cl.[3] ..... G04B 1/00

[52] U.S. Cl. ..... 368/204; 368/62; 368/203

[58] Field of Search ..... 58/23 R, 23 A, 23 BA, 58/50 R, 23 AC; 321/15, 16; 368/62, 66, 203, 204, 223

[56] References Cited

U.S. PATENT DOCUMENTS

| | | | |
|---|---|---|---|
| 3,701,249 | 10/1972 | Bergey et al. | 58/23 R X |
| 3,823,546 | 7/1974 | Gortz et al. | 58/23 R |
| 3,946,550 | 3/1976 | Fujita | 58/23 BA X |
| 3,950,940 | 4/1976 | Nishimura et al. | 58/23 A |
| 3,958,187 | 5/1976 | Suzuki et al. | 58/23 A X |
| 3,999,368 | 12/1976 | Yoshida | 58/23 BA |
| 4,014,165 | 3/1977 | Barton | 58/23 BA |
| 4,041,691 | 8/1977 | Chihara et al. | 368/66 |

*Primary Examiner*—Ulysses Weldon

*Attorney, Agent, or Firm*—Sherman & Shalloway

[57] ABSTRACT

An electronic timepiece comprising a threshold voltage based constant voltage regulator circuit, which provides the regulated voltage to a first part of the timepiece system including an oscillator and a divider. The signal from the first part is transferred to a second part of the timepiece which is provided with a voltage from a power supply source directly. The regulator circuit improves the voltage dependence of the timepiece system such as current consumption, frequency stability, etc.

9 Claims, 14 Drawing Figures

(to FIG. 5II)
500
501
502
503
504
505
506
507
508
509
510
511
512
513
514
515
520
521
522
530
531
532
561
562
563
564
580
581
582
596
597
598
599
Diff-R (3K)
Diff-R (300K)
MOS-R (30M)
Diff-R (500K)
MOS-FET
Xtal
BATT.
VDD
VSS1
VSS1/2
VSS2/3
Φ64HZ
ΦADD
ΦEXT (FIG. 5I)

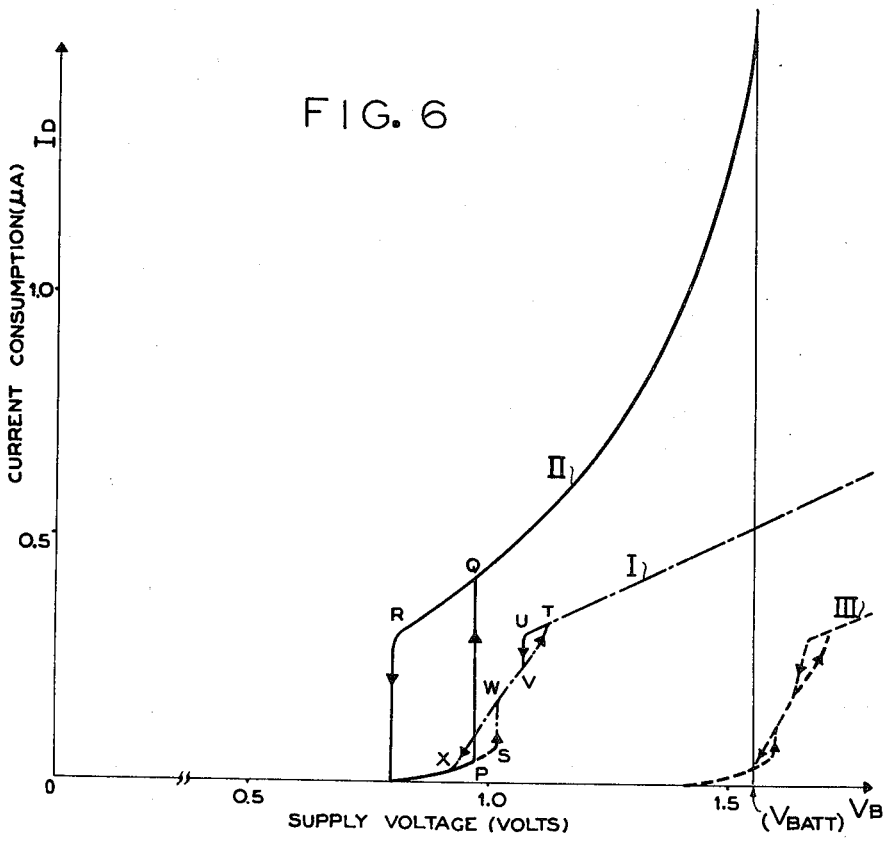
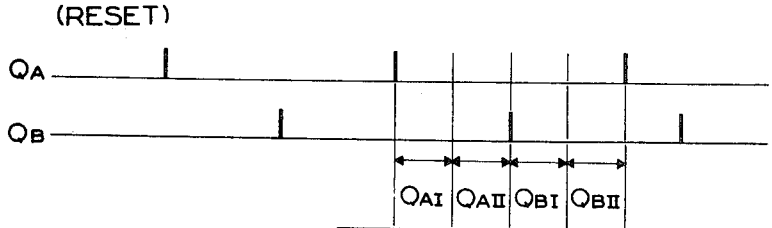
| | $Q_{AI}$ | $Q_{AII}$ | $Q_{BI}$ | $Q_{BII}$ |
|---|---|---|---|---|
| $\overline{Q_{15}}$ | H | L | H | L |
| $Q_{16}'$ | L | H | H | L |
| $Q_{16}$ | L | L | H | H |
FIG. 7C

LOW-POWER INTEGRATED CIRCUIT FOR AN ELECTRONIC TIMEPIECE

This is a continuation-in-part of Ser. No. 721,440, filed Sept. 8, 1976, now abandoned.

BACKGROUND OF THE INVENTION

1. Field of the Invention

This invention relates to an electronic timepiece and, especially, to the timepiece system with an improved voltage characteristic. A threshold voltage based regulator circuit adapts the voltage of the battery to the best operation voltage of the integrated circuit comprised in the timepiece system.

2. Description of the Prior Art

Heretofore, when an operational voltage of an electronic timepiece is predetermined, the reference voltage of its display section is a voltage which has the operational lower limit voltage of the display elements and the battery voltage. For example, the operational voltage of a timepiece circuit is predetermined at 1.5 volts of a battery cell and that of a liquid crystal display circuit is preset at DC-DC converted up to 3.0 volts, and a level shift circuit is used for driving a display system.

However, several improvements need to be considered in the above-mentioned systems with the view of reducing power consumption.

Firstly, it is not essential that a timepiece circuit should be directly operated by a battery cell voltage. If the voltage of the timepiece circuit is lowered to a lower limit voltage determined by theoretical and practical considerations, a supply voltage may also be able to be reduced to the limit voltage. Furthermore, the impedance of the timepiece circuit is invariable and the power consumption may be reduced in proportion to the inverse of the supply voltage.

Secondly, of course, the operational starting voltage of an integrated circuit depends on its characteristics, but, for example, the threshold value of each transistor in an integrated circuit such as C-MOS FET (Complementary Metal Oxide Silicon Field Effect Transistors) deviates depending upon the process condition of manufacture of the integrated circuit, whereby the current consumption changes in proportion to the square of the number of the difference between a supply voltage and operational starting voltage. Therefore, wasteful power consumption is large in a practical timepiece circuit design when taking into account its oscillation gain margin concerning the distribution of deviations and fluctuations of the battery voltage. Thus, if the battery cell and the timepiece circuit are coupled with each other through a circuit means having a buffer function about the voltage difference, the power consumption may be reduced substantially.

Thirdly, it is not significant that each of the circuit blocks exists individually. It is significant that a signal can be delivered to another circuit and the structure is designed so that the circuits effect a function similar to the function of a conventional circuit notwithstanding the fact that some circuit blocks are operating at a reduced voltage. For example, a circuit having a function of transacting energy such as driving of display elements or a pulse motor may be combined with a reference signal circuit. For this purpose, it is required that provision be made for a level shift circuit to raise the voltage which is lower than that of the battery voltage and for delivering the raised voltage to the other circuit.

SUMMARY OF THE INVENTION

An object of this invention is to provide an electronic timepiece system comprising a threshold voltage dependent regulated constant voltage source circuit connected to a power source. A first part of the timepiece system, including a crystal oscillator and a divider circuit, is supplied with said regulated voltage. A second part of the timepiece system, including gates and a driver circuit, is supplied with a voltage from the power source directly. The signal from the first part of the system is sent to the second part of the system through a level shift circuit. The threshold dependent voltage regulator saves the current consumption of the oscillator, the wave shaper and the divider circuit when the output voltage of the power source exceeds the operation voltage of the circuits by a significant amount. The threshold dependent voltage regulator circuit improves the voltage dependence of the timepiece system such as current consumption, frequency coefficient and delay time, and as a result, the yield of the integrated circuit of said timepiece system is improved.

BRIEF DESCRIPTION OF THE DRAWINGS

The above and other features of this invention will be described in greater detail hereinafter with reference to the accompanying drawings in which:

FIG. 6 is a graph showing voltage-current characteristics of timepiece circuit systems according to this invention;

FIG. 7C is a timing chart and table showing a resetting mode;

DETAILED DESCRIPTION OF PREFERRED EMBODIMENTS

Figure 1:
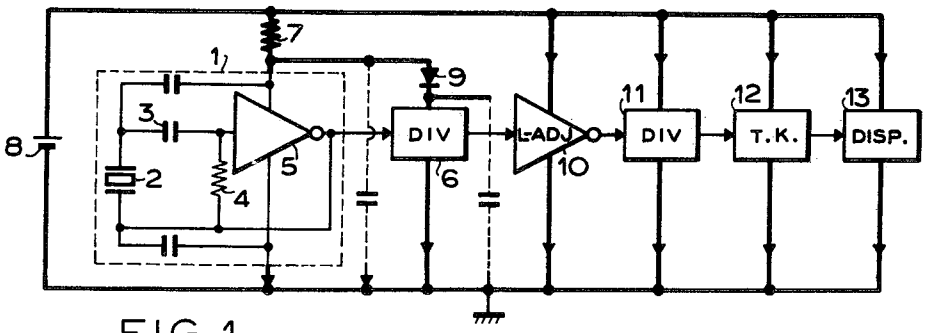
FIG. 1 is a block diagram showing a brief structure of an electronic timepiece system for understanding the operation of this invention.

In FIG. 1, reference numeral 1 illustrates a high frequency time reference signal source comprising a crystal oscillating element 2, coupling condenser 3, bias setting resistor 4 and inverter 5. The output from the time reference signal source is delivered to the frequency divider 6 so as to synthesize the time count unit signal. Reference numeral 8 depicts a battery cell, of which power supply source voltage is applied to the inverter 5 via a resistor 7 and is applied to the frequency divider 6 through a diode 9.

The output of the frequency divider 6 is applied to a next frequency divider 11 through a level shifter constituting complementary metal-oxide-semiconductor (C/MOS) converter 10. Then, the output of the frequency divider 11, i.e., a time count unit signal operates a time keeping means 12 so as to drive a time display means 13 consisting of, for example, a liquid crystal cell. Thus, the voltage across the battery cell 8 is applied directly to the inverter 10, frequency divider 11, time keeping means 12 and time display means 13.

The voltage drop resistor 7 has a resistance value such that a voltage may be applied which is slightly higher than oscillation starting voltage to the time reference signal source 1 and further that a voltage applied may be slightly higher than the frequency starting voltage applied to the frequency divider 6. Therefore, the time reference signal source 1 and frequency divider 6 do not waste power when effecting necessary functions. On the other hand, elements connected to the following step to the level shifter 10 consumes very little power even if the high power source voltage is applied thereto, since the frequency of an applied signal is low in frequency so that the number of the state variations is decreased. As the result, the drop of the battery voltage effects the power consumption, and thereby the life of the battery cell can be lengthened.

Figure 2B:
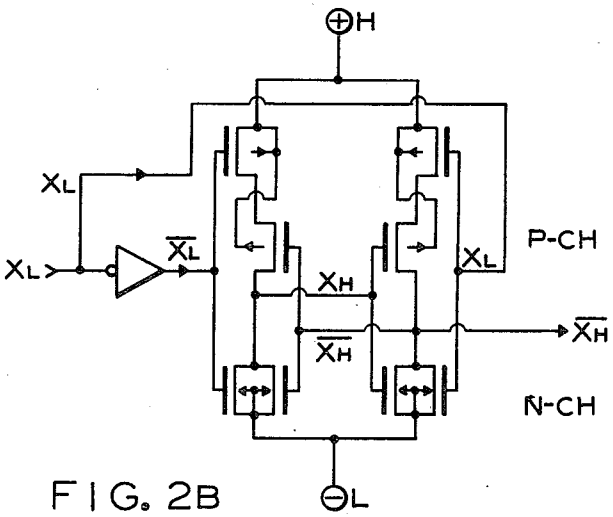
FIGS. 2A and 2B are circuit diagrams showing modified embodiments of a level shift circuit in FIG. 1 or FIG. 3.
Figure 2A:
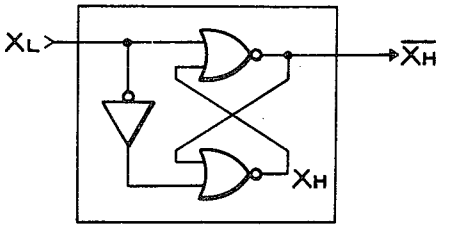

FIGS. 2A and 2B show a modified level shifter 10 used in FIG. 1. This modified level shifter 10 is especially useful for level-shifting in C/MOS circuits in which the differences of voltage levels are large, since it is small in power consumption and easily incorporated into an integrated circuit. The following explanation sets forth details of the level shifter 10. A signal $X_L$ is a signal whose level is slightly lower than the high level voltage signals. A signal $X_H$ is a signal synthesized from the signal $X_L$ and is a higher level voltage thereof being as high as the power source voltage. The lower level of the voltages of the signals $X_L$ and $X_H$ are assumed to be different from each other. In the case when the higher level voltages are substantially equal to each other, the NOR circuit made of a C/MOS circuit is replaced by NAND circuit, for example, in a flip-flop type level shifter as shown in FIG. 2A. FIG. 2B shows a case where the NOR circuit in FIG. 2A is made of a C/MOS circuit.

In FIG. 2B, two N-channel transistors are connected in parallel with each other and two P-channel transistors corresponding thereto are connected in series with each other. The source electrode of each of the transistors of each channel is connected to a power source and the drain electrode to both P- and N-channel transistors are connected. Therefore, if at least one of two inputs of the NOR circuit is at the high level, the output is set at the low level. As the result, the logical value of the output is not influenced with the remaining input signal and is independent of the level of the remaining input signal. In addition, even if the remaining input signal is at a halfway voltage level, being neither the high level or low level, there is no component of a through current flowing because of the short-circuiting of the power source through both the P- and N-channel transistors. Therefore, the high level of the signal $X_L$ in the NOR circuit may be at an insufficient voltage level. However, there is a single condition which is required. Namely, for example, it is essential that the output voltage of the NOR circuit can be changed from the high level to the low level by a high level signal of a voltage slightly below voltage $X_L$ when a feedback input signal is not the input signal $X_L$ in the NOR circuit. For this purpose, the mutual conductance Gm of the N-channel transistor receiving the input signal $X_L$ should be made large and that of the P-channel transistor should be made small. In addition, even if the P-channel transistor is turned on, the N-channel transistor of the input signal $X_L$ is turned on at the input $X_L$ by a slightly lower voltage. Therefore, the output level should be compulsorily set to the low level even if insufficient. The reason why the set level may be insufficient is because the output level is gradually dropping to the complete logical level by itself since the NOR circuit forms a positive feedback loop. The same condition is required by the NOR circuit at the side of the input $\overline{X}_L$. In other words, the mutual conductance Gm of the N-channel transistor at the side of the input $\overline{X}_L$ is required to be large and that of the P-channel transistor not positioned at the side of the input $\overline{X}_L$ is required to be small.

This level shifting circuit results in a limited current flow at a transient state. Therefore, the power consumption is of no account in the level shifting at a low frequency. This is because in the response of the output signal to the variations of the input logical value, the state is inverted quickly due to the peculiar velocity of the NOR circuit once the variations of the state occur. The time of the transient state is short because the state reaches another ordinary state since a positive feedback loop is formed.

Figure 3:
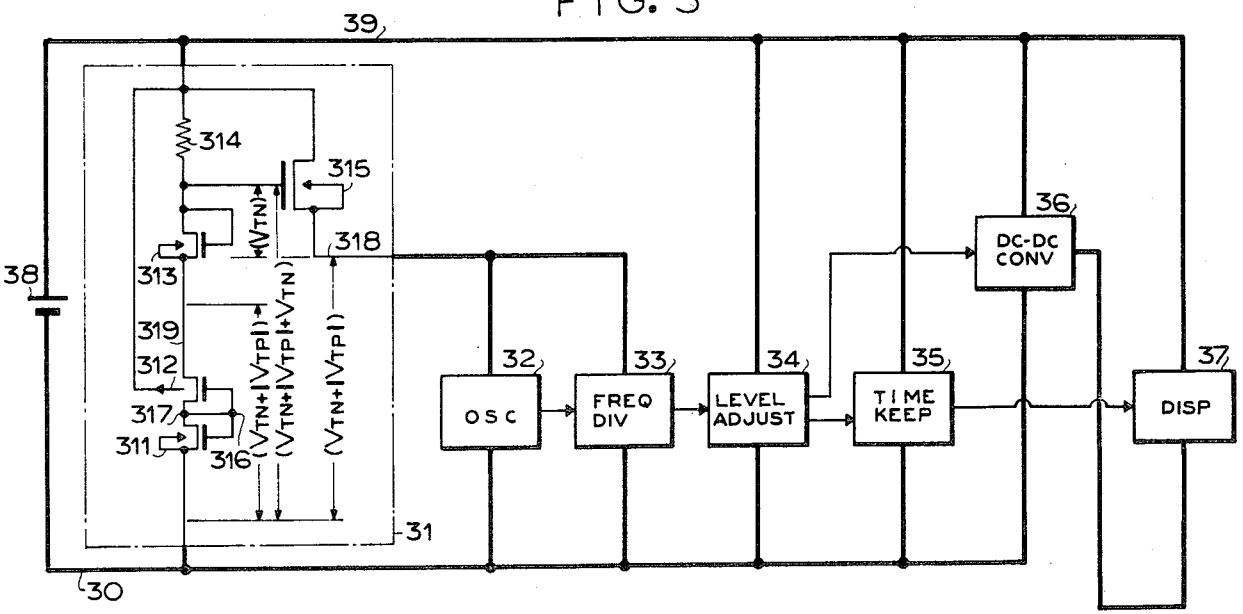
FIG. 3 is a block diagram showing a modified embodiment of the electronic timepiece circuit provided with a threshold dependent voltage regulating circuit.

FIG. 3 shows an example of a circuit which can be modified as shown in FIG. 1, but the preferred embodiment is the system as shown in FIG. 3.

Reference numeral 31 depicts a threshold based constant voltage regulator circuit, 32 a time reference signal source composed of a crystal oscillation circuit, 33 a time counter unit signal synthesizing means, 34 a level shift circuit, 35 an electronic time keep means, 36 a DC/DC converter and 37 a time display means.

A thick line between blocks indicates an energy path and a thin line illustrates a signal path. The output voltage from the voltage regulator circuit 31 is regulated, depending upon the device parameter of the transistor, such as threshold voltage, mutual conductance, such that it becomes equal to the sum of the absolute threshold value of P-channel and N-channel transistors. In an inverter circuit composed of a complementary type transistor, i.e., N-channel enhancement type transistor 311 and P-channel enhancement type transistor 312, its input terminal 316 and output drain terminal 317 are coupled to each other. The current increases much more as the applied voltage is increased. When the voltage of the power source in the inverter is larger than the sum of the threshold voltage $V_{TN}$ of the transistor 311 and the absolute value of the threshold voltage $|V_{TP}|$ of the transistor 312, the inverter is used like a Zener diode. Actually, the drain gate voltage is determined by the mutual conductance, threshold voltage and the load resistor 314.

When an extremely small current is supplied through a high value resistor 314 to the inverter circuit, and the voltage across the power source terminal of the inverter is of low impedance as a result of a large Gm source follower circuit constituting a transistor 315, a voltage drop occurs in the threshold voltage $|V_{TP}|$ of the transistor 315 between the gate input voltage and source output voltage in the source follower circuit. For the purpose of compensating for the voltage drop, use may be made of a circuit in which the gate and drain of the transistor 313 are connected with each other and the circuit is designed such that a voltage which is $V_{TN}$ higher than ($V_{TN}+|V_{TP}|$) may be supplied to the gate of the transistor 315. The power source voltage from a battery cell 38 is applied to lines 30, 39 and there is generated the voltage ($V_{TN}+|V_{TP}|$) controlled in accordance with the threshold voltage of the transistor. For example, let the power source voltage be 1.58 volts, $V_{TN}$ 0.4 volts and $|V_{TP}|$ −0.3 volts, ($V_{TN}+|V_{TP}|$) results in 0.7 volts.

The output voltage from the voltage drop circuit is not varied when the voltage of the battery cell lowers due to the power consumption of the battery cell or due to alarming of a special sound requiring a large power. The oscillation frequency of the crystal oscillator 32 is kept constant. In the case where the threshold voltage of the transistor is varied as $V_{TN}=0.3$ volts, $|V_{TP}|=-0.35$ volts, the output voltage becomes 0.65 volts accordingly so that a voltage equal to or actually a little more than the voltage ($V_{TN}+|V_{TP}|$) is always applied to the oscillator 32 and frequency divider 33.

It is possible that the output voltage of the voltage drop circuit 31 is finely adjusted by adjusting the value of the resistor 314 and mutual conductance of the transistors 311, 312, 313. The transistor 315 results in the voltage ($V_{TN}+|V_{TP}|$) on the line 319 being derived from the line 318 at low impedance. The differentiated output impedance on the line 319 can be an extremely low value by enlarging the mutual conductance of the transistor 315. As the result, the output voltage is kept constant even if a load current changes suddenly and thus the reliability of the circuit operation is improved.

It is apparent that the lower voltage operation of the timepiece system can save current consumption which occurs when there is the mismatching between the battery voltage and the low operation voltage of the integrated circuit system. The practical system construction for reducing the voltage of the battery to adapt the integrated circuit is the keypoint. The first method is to connect a voltage drop means such as a resistor or a diode. The second method is to arrange a current source circuit. A constant current source circuit provides a power to the timepiece system independent of the threshold voltage of the timepiece system. Above-described methods cannot limit the current to a small value. In fact, a C/MOS circuit operates at a small current in mean value, but depending upon the gate input waveforms, fairly large transient current consumption occurs which is proportional to the square of the voltage difference of the battery voltage and the sum of the threshold voltage. As a result, the limited current must be larger than such transient current. If the limited current is smaller than said transient current, malfunction occurs. Then the current limitation cannot reduce the mean value of the current consumption so much. The third method is to provide a constant low voltage source circuit, which can provide the transient current efficiently. But there will exist a difficulty of some voltage mismatching. The deviation of the threshold voltage, depending upon the manufacturing processing, requires a threshold depending voltage source circuit for good operation and small current consumption. After all, the threshold dependent voltage regulator circuit as shown in FIG. 3 is to be adapted to a conventional voltage dropped timepiece system as shown in FIG. 1 to accomplish the expected lower current consumption and better stabilized operation of the timepiece system.

Figure 4:
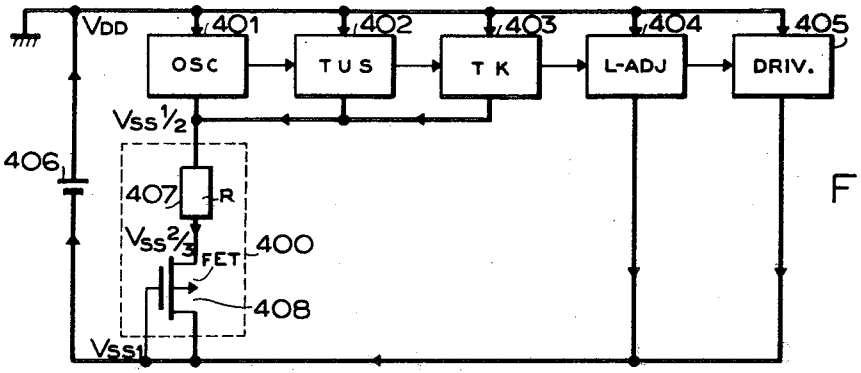
FIG. 4 is a block diagram showing the system of an integrated circuit in FIG. 5.
Figure 5I:
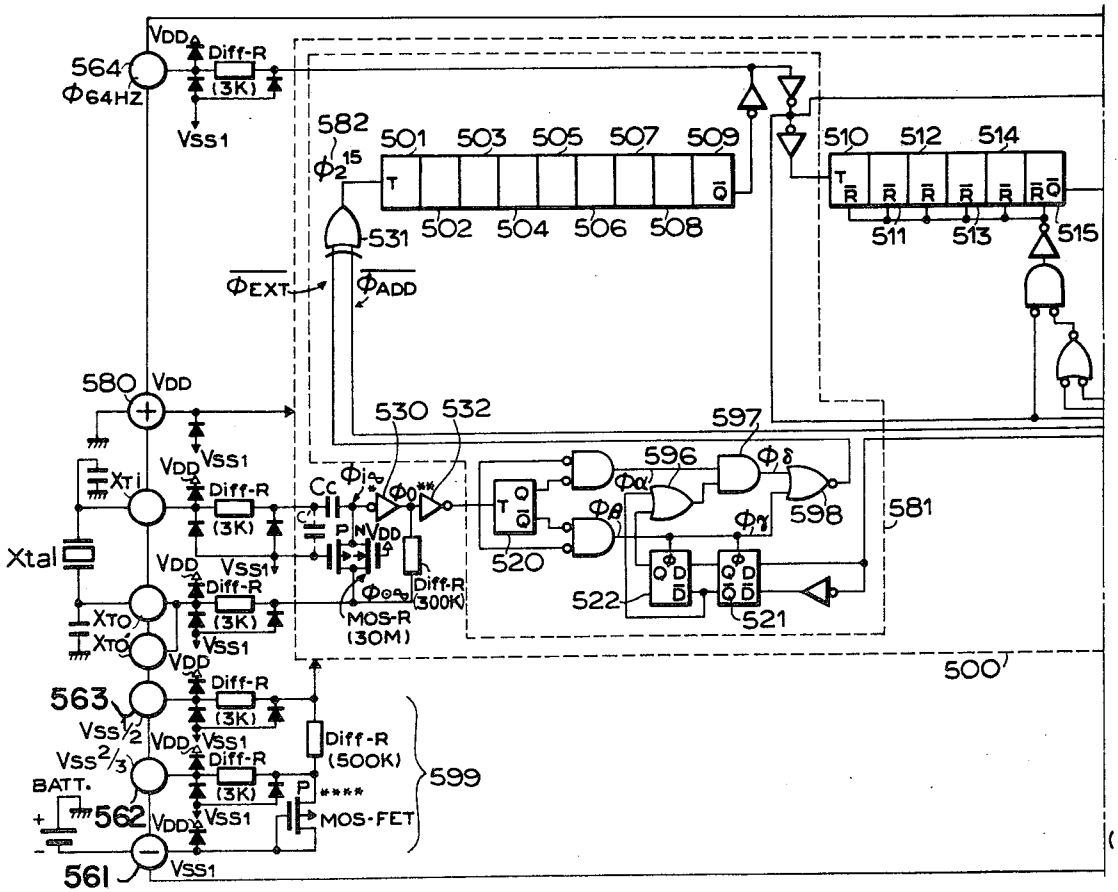
FIG. 5 (i.e. 5I and 5II) is a circuit diagram showing a detailed embodiment according to this invention.
Figure 5I:
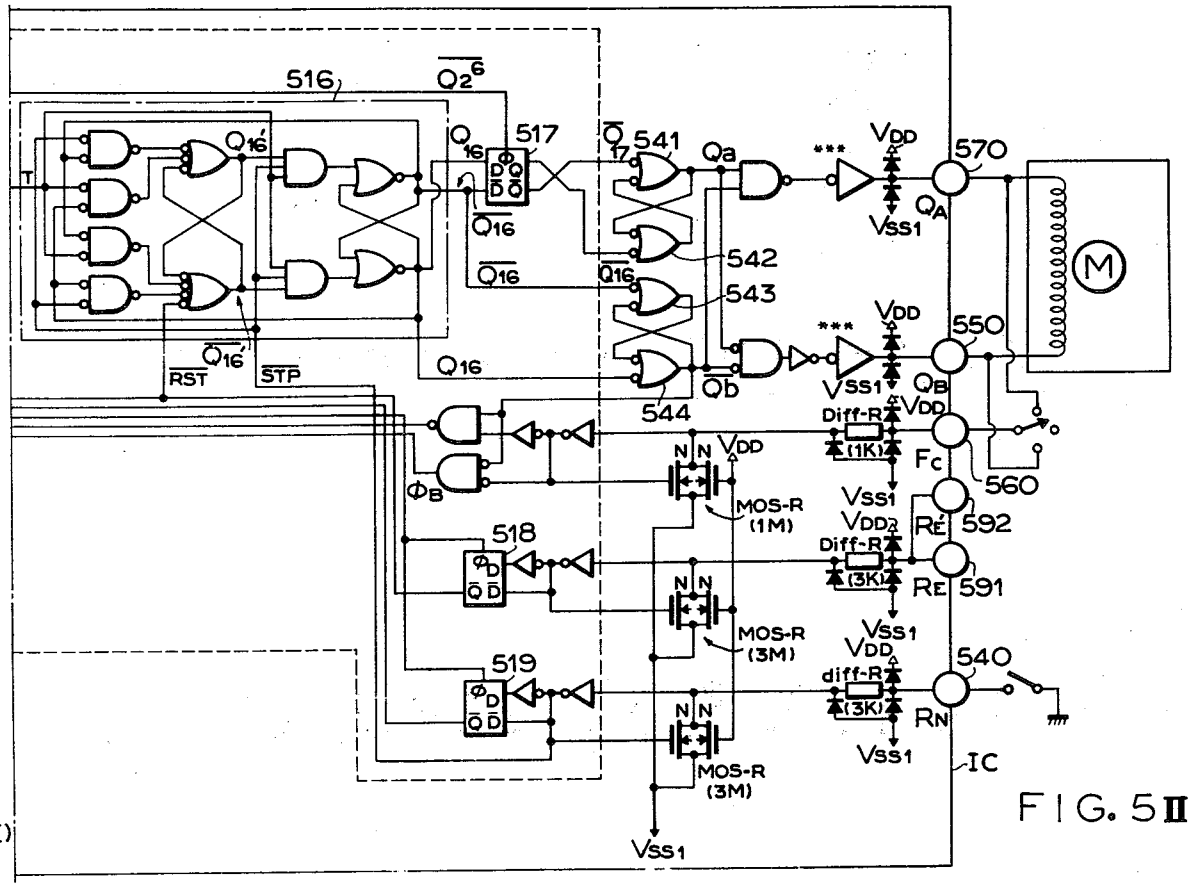

FIG. 4 is a block diagram showing the system in an embodiment of an integrated circuit in FIG. 5. In FIG. 5, an electronic mechanical quartz crystal timepiece C/MOS integrated circuit system for multi-voltage-level operation experiments is shown. In FIG. 5, the low voltage source is simply drafted as a voltage conversion circuit. For better operation, the voltage regulator circuit as shown in FIG. 3 is to be adapted to the circuit as shown in FIG. 5 as a voltage conversion circuit. In FIG. 4, a thick line indicates an energy path and a thin line illustrates a signal path. Reference numeral 400 designates a voltage converting circuit which reduces the power consumption and 401 a time reference signal source including a crystal oscillating element of 32 KHz, 402 a time count unit signal synthesizing means, 403 a time keeping means, 404 a level shift circuit and 405 a driving circuit of which the output is for driving two electrode pulse motors. The voltage converting circuit 400 constitutes a current control circuit provided with a voltage control resistor utilizing the threshold value of a field effect transistor. The voltage converting circuit 400 synthesizes a voltage lower than the power source voltage. In this embodiment, the low voltage is at about a half of the power source voltage which is shown as $V_{SS\frac{1}{2}}$ and the connection point of the resistor 407 and field effect transistor 408 which is at $\frac{2}{3}$ voltage of the power source voltage is shown as $V_{SS\frac{2}{3}}$.

The time reference signal source 401, time count unit signal synthesizing circuit means 402 and time keep means 403 are operated by the low voltage. The level of the output signals therefrom is shifted so that the output for driving a pulse motor may be synthesized by the driving circuit 405.

The system of the timepiece according to this embodiment has two reset functions for stopping the even number seconds and a function for coarse frequency adjustment. The controllable range of the frequency is ±0.0015% and the combination of a trimmer capacitor, etc., enables extremely highly precise frequency adjustment.

Hereinafter, this system will be described in greater detail by means of a practical circuit. In FIG. 5, reference numeral 500 depicts a low voltage operating circuit means comprising a time count unit signal synthesizing means 581 and flip-flops 520, 521, 522 and Exclusive OR circuit 531, etc. The output $\emptyset o$ from an oscillating inverter 530 is not a complete rectangular wave form and the input of the time count unit signal synthesizing means 581 is delivered through an inverter 532 with a low mutual conductance for shaping wave forms. The output of the time count unit signal synthesizer 581 is counted down to 0.5 Hz by means of toggle-type flip-flops 501 through 516.

D-type flip-flop 517 is for delaying the output of the flip-flop 516 and the combination of the output signal from the flip-flops 516, 517 generates the signals $Q_A$, $Q_B$ for driving a pulse motor M. A level shift circuit comprises four NOR circuits 541 through 544 with two inputs each. A terminal 560 is a frequency control terminal, a terminal 591 is a reset terminal for stopping the even number seconds and a terminal 540 is a reset terminal for stopping the desired number second. Ordinarily a 64 Hz signal is derived from a terminal 564 and conversely the insertion of a signal into the terminal 564 enables the operation of circuits following after the flip-flops 510.

Under an ordinarily operating condition, the circuit 500 corresponding to the time reference signal source 401, time count unit signal synthesizer 402 and time keep means 403 in FIG. 4 are operated by the voltage $V_{ss\frac{1}{2}}$ generated by means of the low voltage regulating circuit 599.

The integrated circuit according to this embodiment is operable at each of the voltages $V_{ss\frac{1}{2}}$, $V_{ss\frac{2}{3}}$, $V_{ss1}$ by selectively short-circuiting the terminals 563, 562, 561, respectively.

Figure 7A:
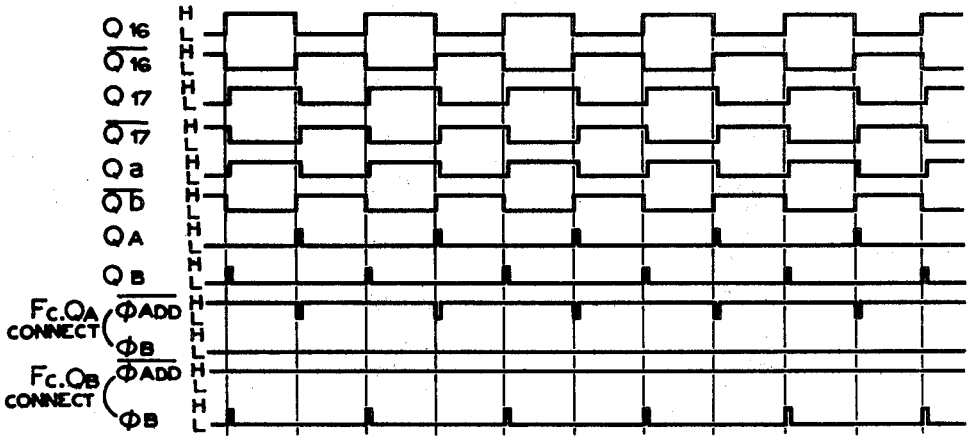
FIGS. 7A and 7B are timing charts showing pulse trains to explain the system of rough frequency adjustment according to this invention.
Figure 7B:
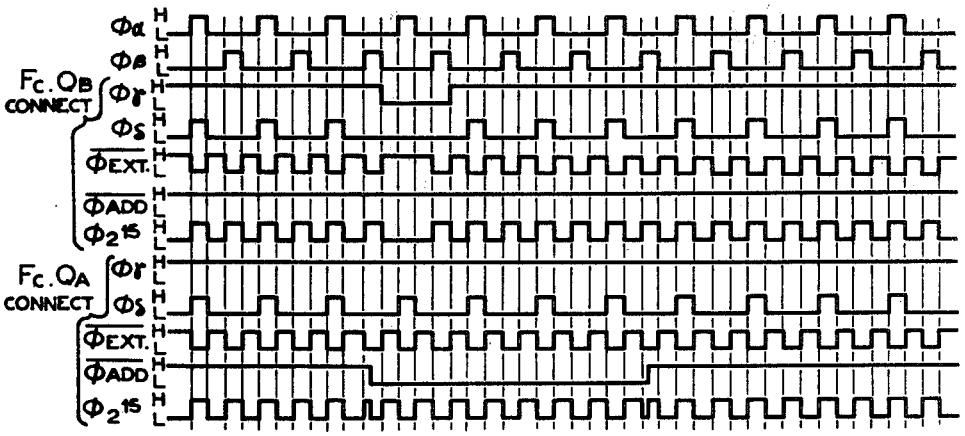

Next, rough frequency adjustment will be explained with reference to timing charts of FIGS. 7A and 7B. In case that rough frequency adjustment is not effected, the terminal 560 is kept open. This open state results in signal $\overline{\phi_{ADD}}$="H" (high level) and $\phi_B$="L" (low level) since signal $F_c$ is at "L". As the result, rough frequency adjustment is not effected. On the other hand, rough frequency adjustment can be effected if the output terminal 560 is connected to the output 570 or 550. If the output terminals 560, 570 are connected with each other, a logical level of the output $\phi_B$ is kept at "L" and thereby the output $\overline{\phi_{ADD}}$ becomes $\overline{Q_A}$ which is an inverted value of $Q_A$. Furthermore, if the terminals 560, 550 are connected with each other, the output $\overline{\phi_{ADD}}$ is kept at "H" and $\phi_B$ is completely equivalent to $Q_B$. The output $Q_A$ is synchronized with the leading edge of the output $\overline{Q_{16}}$ from the flip-flop 516 and $Q_B$ is synchronized with the trailing edge of $Q_{16}$. The outputs $Q_A$, $Q_B$ are both 0.5 Hz and have a pulse width of substantially 7.8 milliseconds. The outputs $\phi_\Delta$, $\phi_\beta$ have $\frac{1}{4}$ duty cycle and frequency of $2^{14}$ Hz. The output $\phi_B$ is also utilized as a clock signal for flip-flops 521, 522. The flip-flops of this embodiment are trailing edge trigger type ones as distinguished from data-type or toggle-type flip-flops.

The output $\phi_\gamma$ of the OR gate 596 in the time count unit signal synthesizer is equal to $\overline{Q_{21}}+Q_{22}$. If the terminal 560 is opened or the terminals 560, 570 are connected with each other, the output $\phi_B$ is always at "H" and thereby $\phi_\gamma$ being always at "H". If the terminals 560, 550 are connected with each other, $\phi_\beta$ has the same wave form as that of $Q_B$ though the voltage level between "H" and "L" is different since the level shift has been effected. "L" is generated for 1 cycle ($\frac{1}{2}^{14}$ sec.) synchronized with the trailing edge of $\phi_\beta$ every two seconds. As the result, the output from AND gate 597 is substrated by one pulse. The output $\overline{\phi_{EXT}}$ of NOR gate 598 is equal to $\overline{\phi_\alpha \cdot \phi_\gamma+\phi_\beta}$, the output $\phi_2$15 from Exclusive or gate 531 is equal to $\overline{\phi_{EXT}}+\overline{\phi_{ADD}}$, $\overline{\phi_{ADD}}$ is always at "H" and as the result, the output $\phi_2$15 from Exclusive or gate 531 is equal to the frequency which is subtracted by one pulse every two seconds. Accordingly, the connection of the terminals 560 and 550 results in the frequency control of $-1/12^{15}$ per 0.5 Hz, that is, about $-15$ PPM ($0.5/2^{15}$).

If the terminals 560, 570 are connected with each other, the output $\overline{\phi_{EXT}}$ has the same wave form as one delivered to the time count unit signal synthesizer through the wave form shaping inverter. $\overline{\phi_{ADD}}$ has a wave form of reverse phase as compared with $Q_A$.

However, there is a time delay during passing through C/MOS gate from 531 to 517, etc., and as the result, a phase shift is generated as shown in the timing charts. Therefore, the output $\phi_2$15 is added exclusively by the Exclusive OR gate 531. It can be clearly seen on the timing chart whether the frequency control is accomplished or not if the number of leading edges or trailing edges is counted for a certain period, for example, from immediately before $\overline{\phi_{ADD}}$ becomes at "L" to immediately after it becomes at "H". Namely, the output $\phi_{12}$15 is one more than $\overline{\phi_{EXT}}$ in the number of leading edges or trailing edges, and as a result, it is equal to the sum of adding one pulse to the output of the oscillator.

As seen from the above, the phase lags by 15 PPM when the terminal 560 is connected with the terminal 550 and is ahead when the terminal 560 is connected with the terminal 570.

Referring to the insertion of a reset signal to stop the second hand, four signal modes are shown in FIG. 7C regarding the timing of the insertion of a reset signal. Here let four periods be $Q_{AI}$, $Q_{AII}$, $Q_{BI}$, $Q_{BII}$.

Figure 7D:
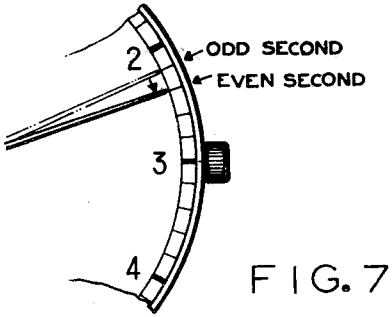
FIG. 7D is a schematic view of inserting odd second and even second signals.

In FIG. 7D, the signal $\overline{RST}$ is delivered when the even second stop signal is inserted into an even second and the signal $\overline{STP}$ is delivered when the desired second stop signal is inserted.

In any cases, the flip-flops 510 through 515 are reset instantly.

Figure 8B:
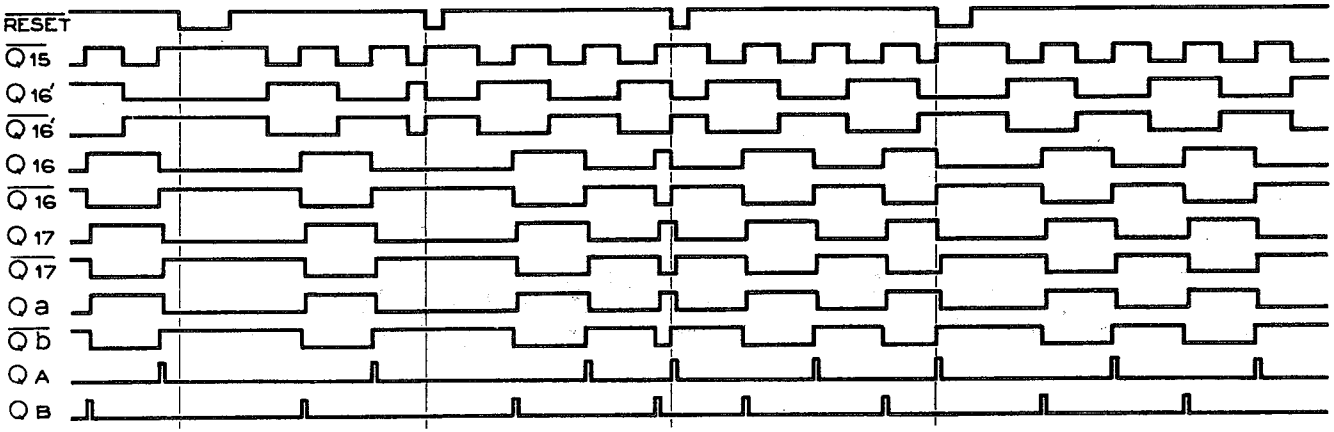
FIGS. 8A and 8B are timing charts showing pulse trains which explain the system of resetting operation according to this invention.
Figure 8A:
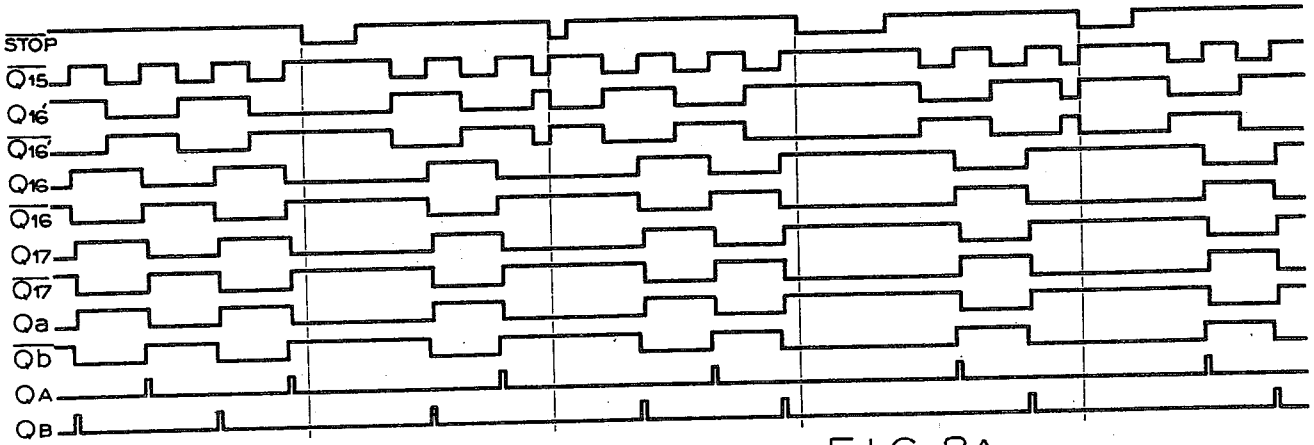

In FIGS. 8A and 8B, the periods $Q_{AI}$, $Q_{AII}$, $Q_{BI}$, $Q_{BII}$ are arranged from the left side on the timing chart wherein wave forms are shown upon the insertion of a reset signal.

In the case when the even number second is stopped, the signal $\overline{RST}$ and driving pulse are not overlapped with each other. Therefore, the pulse width of the drive pulse for a pulse motor is kept constant, and as the result, there is no occurrence that the second hand of the timepiece does not operate unstably.

When the desired second stop signal is inserted under each of four modes, the operation is as follows:

(1) the periods $Q_{AI}$ and $Q_{AII}$ instant stop is effected, reset is released and then the side of the terminal 550 operates after one second from the release thereof.

(2) the periods $Q_{BI}$ and $Q_{BII}$

Instant stop is effected, reset is released and then the side of the terminal 570 operates after one second from the release thereof.

When the even number second stop signal is inserted under each of four modes, the operation is as follows:

(1) the periods $Q_{AI}$ and $Q_{AII}$

Instant stop is effected, reset is released and then the side of the terminal 550 operates after one second from the release thereof.

(2) the periods $Q_{BI}$ and $Q_{BII}$

The signal of the terminal 570 is delivered in the instant of resetting and then stops, and if the reset is released, the side of the terminal 550 operates after one second from the release thereof.

As seen from the above, the terminal 570 is for the even number second output and the terminal 550 is for the odd number second output. In conclusion, the second hand always stops at an even number second and starts from an odd number second after one second from releasing the reset if the even number second stop signal is inserted.

In FIG. 6, shown are voltage-current characteristics of a timepiece system according to this experimental C/MOS circuit as shown FIG. 5. A curve (I) shows characteristics in the case where the terminals $V_{ss\frac{2}{3}}$ and $V_{ss1}$ are shortcircuited with each other in FIG. 5, wherein both functions of voltage drop and level shift operate effectively. A curve (II) shows the case that the terminals $V_{ss\frac{1}{2}}$ and $V_{ss1}$ are shortcircuited and the timepiece circuits are all operated at the voltage ($V_{DD}-V_{ss1}$) so as to indicate voltage-current characteristics of the conventional timepiece circuit systems. The curve (I) shows that the timepiece circuit operates normally on the right side from a point T along points P→S→W→V→T if the power source voltage is raised up from zero volt and operates along points T→U→V→W→X if the power source voltage is lowered. The curve (II) illustrates that the timepiece circuit operates from a voltage being lower than that of the curve (I), the point P moves to the point Q and normally operates on the right side (high voltage side) of the point Q. In this case, the operating point is shifted from the point Q to the point R of the voltage.

A curve (III) is positioned at the position where the curve (I) is shifted in the right direction and shows the operating characteristics when the terminals $V_{ss2}$ and $V_{ss1}$ are opened. An integrated circuit for use in the timepiece circuit of this invention is designed such that the same integrated circuit may be used for large scale crystal clock operating at high voltage as well as a crystal wristwatch operating at low voltage.

According to a current axis, the normal operating characteristics is more than 0.45 μA in the curve (II) and is more than 0.35 μA in the curves (I), (III).

Referring to operation starting current, the curves (I), (II), (III) illustrate about equivalent value, i.e., 0.4 μA or so, but they are different in current increase at the area wherein the operation starting voltage is exceeded. Namely, in this area, the curve (II) increases by rate of square number of the voltage while the curves (I) and (III) only increase linearly. In addition, the curve (III) shows that the rate of the current increase is substantially equal to that of the curve (I) though the operating voltage is high.

Referring to the power consumption, the curve (II) shows that it increases in proportion to a cube of the supply voltage while the curve (I) shows that it increases in proportion in a square thereof.

In the system shown by the curve (I), if the supply voltage is 1.58 volts, the range of the operation voltage is from 1.35 to 1.65 volts and the dispersion voltages of the threshold value are 0.2 volts respectively, $V_{TN}+|V_{TP}|$ becomes equal to 0.95 volts under the worst condition. In this case, if the curve (I) is shifted by 0.1 volt in the left direction, the current consumption is about 0.6 μA at the voltage of 1.58 volts. In reverse, if $V_{TN}+|V_{TP}|$ is equal to 1.35 volts, the current consumption is 0.35 μA, i.e., 0.5 μA on an average. Adapting this to the curve (II), the current consumption is about 2 μA in case of $V_{TN}+|V_{TP}|=0.95$ volts and is about 0.45 μA in case of $|V_{TP}|+V_{TN}=1.35$ volts, i.e., 1.2 μA on an average. Even in the curve (II), the current consumption is a half of 2.5 μA in the conventional integrated circuit for a timepiece since there is effected a counter-measure to lower the power consumption in the system.

The construction of this invention is applicable to an Integrated Injection Logic ($I^2L$) circuit, Complementary Metal Oxide Silicon (C-MOS) circuit, complementary bipolar circuit and the other ordinary integrated circuit. In addition, the device of this invention may be used in various kinds of portable apparatus and equipments driven by a battery cell such as a calculator, camera circuit, hearing aid and the like as well as a timepiece.

What is claimed is:

1. An electronic timepiece comprising:

(a) a time reference signal source for generating a time reference signal;

(b) a time count unit signal synthesizing means for synthesizing a time count unit signal from said time reference signal;

(c) a time keep means for synthesizing a time keep signal from said time count unit signal;

(d) a time display means for displaying a time information in response to said time keep signal from said time keep means;

(e) a power source for applying electric energy to a first circuit part including said time reference signal source and said time unit signal synthesizing means and to a second circuit part including said time keep means and said time display means;

(f) a device parameter dependent regulated constant voltage source circuit means for connecting said power source to the first circuit part of said timepiece and for providing a first regulated voltage to the first circuit part, said device parameter comprising a threshold voltage of a transistor;

(g) a level shift means receiving a signal from said first circuit part and sending a shifted signal to said second circuit part; and (h) said time reference signal source, said time count unit signal synthesizing means, said device parameter dependent regulated constant voltage source circuit means and said level shift means being incorporated in an integrated circuit.

2. The electronic timepiece as claimed in claim 1, wherein said device parameter is a sum of a plurality of threshold voltages of a transistor circuit.

3. The electronic timepiece as claimed in claim 1, wherein said regulated constant voltage source circuit means comprises a voltage follower circuit having an output and a control and a reference voltage circuit having a transistor connected to the output and the control.

4. The electronic timepiece as claimed in claim 1 further comprising a timepiece circuit means including a complementary transistor circuit comprising a pair of field effect transistors and wherein said voltage source circuit means generates said first regulated voltage by utilizing a voltage drop caused when a current flows through said complementary transistor circuit.

5. The electronic timepiece as claimed in claim 1, wherein said level shift means comprises a level shift circuit connecting a signal having a signal amplitude within that of said shifted signal to set and reset terminals of a bistable circuit connected with said power source of said first regulated voltage.

6. The electronic timepiece as claimed in claim 1, wherein said regulated constant voltage source circuit means comprises a voltage follower circuit having an output and a control and a reference voltage circuit having a transistor connected to the output and the control.

7. The electronic timepiece as claimed in claim 6 further comprising a timepiece circuit means including a complementary transistor circuit comprising a pair of field effect transistors of different conductivity types and wherein said voltage source circuit means generates said regulated voltage by utilizing a voltage drop caused when a current flows through said complementary transistor circuit.

8. The electronic timepiece as claimed in claim 8, wherein said level shift means comprises a level shift circuit connecting a signal having a signal amplitude within that of said shifted signal to set and reset terminals of a bistable circuit connected with said power source of said first regulated voltage.

9. The electronic timepiece as claimed in claim 8, wherein said device parameter is a sum of a plurality of threshold voltages of said complementary field effect transistor circuit.

* * * * *

UNITED STATES PATENT AND TRADEMARK OFFICE

CERTIFICATE OF CORRECTION

PATENT NO. : 4,441,825

DATED : April 10, 1984

INVENTOR(S) : Shigeru Morokawa

It is certified that error appears in the above—identified patent and that said Letters Patent is hereby corrected as shown below:

Claim 8, line 1, delete "8", insert --7--.

Signed and Sealed this

*Sixteenth* Day of *April 1985*

[SEAL]

*Attest:*

DONALD J. QUIGG

*Attesting Officer* *Acting Commissioner of Patents and Trademarks*